US005984552A

United States Patent [19]

Ackermann et al.

[11] Patent Number: 5,984,552

[45] Date of Patent: Nov. 16, 1999

[54] LOCKING LIPSTICK CONTAINER

[75] Inventors: Walter T. Ackermann, Watertown; Thomas F. Holloway, Southbury, both of Conn.

[73] Assignee: Risdon Corporation, Naugatuck, Conn.

[21] Appl. No.: 09/028,105

[22] Filed: Feb. 23, 1998

[51] Int. Cl.[6] ..... A45D 40/12; A45D 40/04

[52] U.S. Cl. ..... 401/74; 401/78; 401/86; 401/88

[58] Field of Search ..... 401/75, 74, 70, 401/68, 78, 86, 116, 88

[56] References Cited

U.S. PATENT DOCUMENTS 4,983,059 1/1991 Holloway ..... 401/74 X
5,649,777 7/1997 Holloway ..... 401/78
5,746,530 5/1998 Oota ..... 401/88

*Primary Examiner*—Henry J. Recla
*Assistant Examiner*—Kathleen J. Prunner
*Attorney, Agent, or Firm*—Dallett Hoopes

[57] ABSTRACT

"Lock" for this impel/repel lipstick container comprises a downward extension at the lower end of the slot in the inner body. The extension is adapted to receive the pomade cup lug and is partly defined by a margin portion facing in opposition to the direction in which the lug is moved when the cam is turned to raise the cup. When a user attempts to propel the pomade upward by turning the cam relative to the inner body, the cam track merely forces the lug against the margin portion of the extension. To unlock, the salesperson applies a tool upward into the base of the lipstick container to raise the pomade cup so that the lug moves upward out of the extension.

6 Claims, 2 Drawing Sheets

LOCKING LIPSTICK CONTAINER

FIELD OF THE INVENTION

This invention relates to a lipstick container of the impel/repel type. More specifically, the invention relates to such a lipstick container having means to block the raising of the pomade until the means is "unlocked" by the retailer.

BACKGROUND OF THE INVENTION

Lipsticks are, of course, available in a wide range of colors and shades, and it is important to the customer that she perceives the selected shade or color as looking good on her. In retail stores there is provided for this purpose a chart showing the different available shades and colors from which the customer can make her selection.

It seems to be human nature, however, that the customer will want to actually rub the pomade of a given shade on her skin to test its appearance. She may even want to apply it to her lips. Clearly, this presents a problem to the retailer for, once the pomade has been used in this fashion, it is unsuitable for sale. Such "shop-worn" lipsticks must be cast into the return bin.

On occasion the customer is satisfied to merely look down into the top of the uncovered lipstick to see the shade of the color or pomade. This can be done without raising the pomade cup and sometimes satisfies the customer that the color or shade is right for her. Given an opportunity, however, the customer will still surreptitiously raise the pomade to get a better look or apply it as noted above. There is a need, therefore, for a lipstick container in which the pomade is retained in down position and can only be "unlocked" for raising of the pomade cup by the salesperson. Clearly, such a locking means would prevent the abuse of the pomade mentioned above.

SUMMARY OF THE INVENTION

In the lipstick container of the present invention there is a tubular inner body having a longitudinal slot and having a base with an opening in the lower end thereof. A cam sleeve rotatably surrounds the inner body and has a spiral track therein, the track having a pitch angle. A pomade cup is reciprocably disposed in the inner body and has a lug integral therewith extending out through the slot and into the track. Locking means for the lipstick comprises a downward extension of the lower end of the slot in the inner body, the extension adapted to receive the lug and being defined by a margin portion generally facing in opposition to the direction in which the lug is pressed by the spiral track as the inner body is turned to raise the cup.

Thus, when a user attempts to propel the pomade upward by turning the cam relative to the inner body with the lug in the extension, the track merely forces the lug against the margin portion of the extension. To unlock, it is only necessary for the sales person to apply a probe or tool upward into the base of the lipstick to raise the pomade so that the lug moves upward out of the extension.

BRIEF DESCRIPTION OF THE DRAWINGS

Further objects and features of the invention will be clear to those skilled in the art from a review of the following specification and drawings, all of which present a non-limiting form of the invention. In the drawings.

DESCRIPTION OF THE PREFERRED EMBODIMENT

Figure 1:
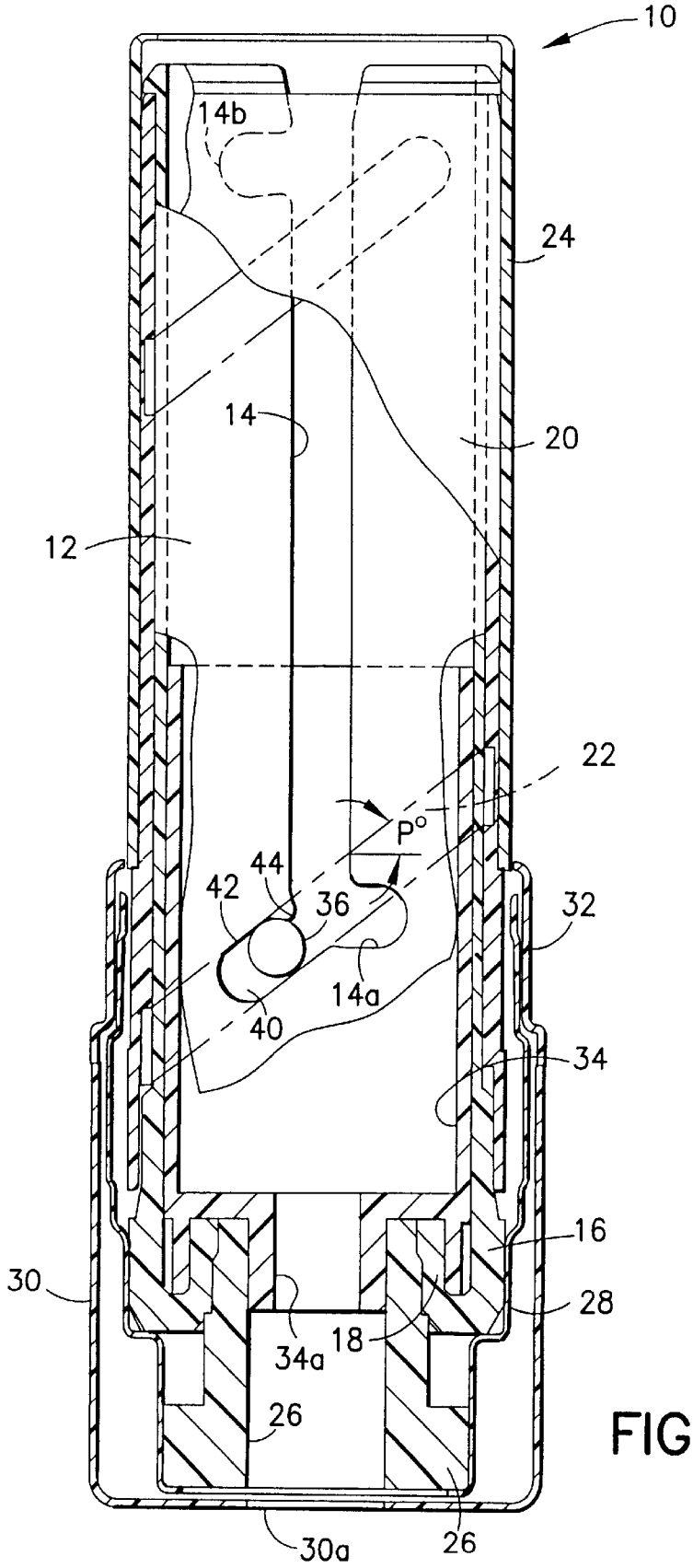
FIG. 1 is a front elevation showing the shell in section with the cam in profile at the upper end and broken away below to reveal the inner body in profile, the inner body being partly broken away farther below to show the inner body and pomade cup in section. Phantom lines show where the cam track overlies the inner body.

A lipstick container embodying the invention is shown in FIG. 1 and generally designated 10. It comprises a tubular inner body 12 having a longitudinal slot 14 formed with lateral extensions 14*a* and 14*b* for reasons well known in the art. Perpendicular extension 14*a* (FIG. 1) is a lug-retaining hold-down slot to hold the cup down against accidental upward movement. The inner body 12 is formed with an enlarged lower end 16 which has a re-entrant portion 18.

Rotatably surrounding the inner body is the tubular cam 20 which is formed with a spiral track 22 having a given pitch angle of slope from the horizontal indicated as $P^o$ in FIG. 1. The tubular cam 20 has cemented to the outside thereof a tubular shell 24.

Into the re-entrant portion 18 of the lower end 16 extends a tubular plug 26. The plug and lower end 16 are bonded together and a sleeve-like liner 28 extends upward from the bottom of the plug to adjacent the lower end of the shell 24. A cup-shaped base 30 having an axial opening 30*a* is secured to the bottom of the plug 26 as by cement. The upper end of the cup-shaped base 30 receives a collar 32 which extends upward and turns inward at the lower end of the shell 24, having clearance therewith to permit the shell to turn. The cup-shaped base 30, being bonded to the liner 28 and the plug 26, turns in unison with the inner body 12.

Completing the assembly is the pomade cup 34, a plastic molded part having a downward annular wall 34*a* and laterally outward lugs 36, only one of which is shown. The lug 36 extends through the slot 14 and outward into the track 22 so that in the usual situation, as opposed to the "locked" situation, infra, turning of the cam relative to the cup-shaped base 30 causes the spiral track 22 to move the lug up or down the slot 14.

Figure 2A:
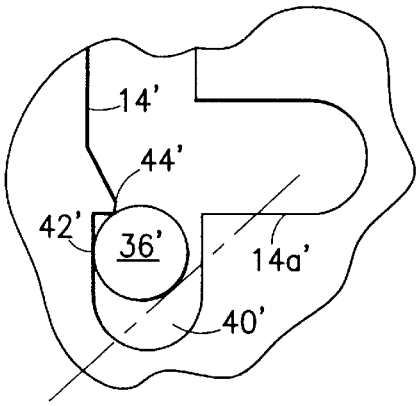
FIG. 2A is similar to FIG. 2 but showing a modified configuration of the extension.
Figure 2:
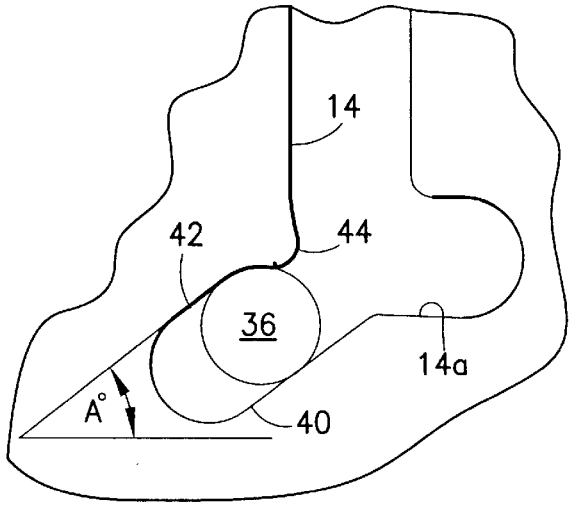
FIG. 2 is an enlarged fragmentary view of a portion of FIG. 1.

The locking means of the invention comprises a downward inclined extension 40 having an upper margin portion 42. Where the upper margin portion 42 merges into the slot 14 (FIG. 2), it is formed with an inward bump comprising a detent 44 at the level of the lug-retaining slot and generally opposite thereto (FIGS. 2, 2A). In assembly and in shipping, the pomade cup is down with lug 36 in the extension 40. In this arrangement, if the cup-shaped base 30 is held and the cam 20 and shell 24 are turned clockwise when viewed from above, the spiral track 22 will move leftward (arrows in FIG. 1) driving the lug upward into the margin portion 42 formed with the detent 44 (FIG. 2). This forms an effective "lock" so that curious shoppers cannot raise the pomade upward in the container. Preferably the angle, Angle $A^o$ in FIG. 2, with the horizontal is equal to the pitch angle $P^o$ (FIG. 1) of the track 22. As shown in FIG. 1, the extension 40 may be parallel and substantially coincident with a portion of the track 22.

Thus, the upper margin portion 42 of the extension generally faces in opposition to the direction in which the spiral track 22 presses the lug 36 when the inner body is turned to raise the cup.

A modified form of the extension 40' is shown in FIG. 2A. In this form the margin portion 42' is essentially vertical and is formed with an inward detent 44'. In the "locked" condition the lug 36 is pressed upward by the track 22 in a direction perpendicular to the track 22. The detent 44' is part of the margin portion 42' against which the lug 36 rests and comprises a surface which is the full equivalent of a surface which generally "faces" in opposition to the direction in which the spiral track presses the lug 36 when the-inner body is turned to raise the cup 36. Thus, the margin portion 42' including the detent 44' is a "lock" against the raising of the cup.

To "unlock" or "clear" the cup 34 for upward movement, the salesperson places the lipstick container base down over the unlocking fixture 50 which is cup-shaped, having floor 52 with a central upward probe 54. The probe 54 will enter opening 30*a* at the bottom of the cup-shaped base, extend upward into the hollow of the plug 26 and engage the underside of the annular wall 34*a*. When the lipstick container is pushed all the way down "home" so that the bottom of the base 30 rests on the annular floor 52 of the fixture, the probe 54 will have raised the cup 34 so that the lug 36 wider than the extension at the detent (FIG. 1) snaps past the detent 44 or 44' and is free to operate in the longitudinal slot 14.

Figure 3:
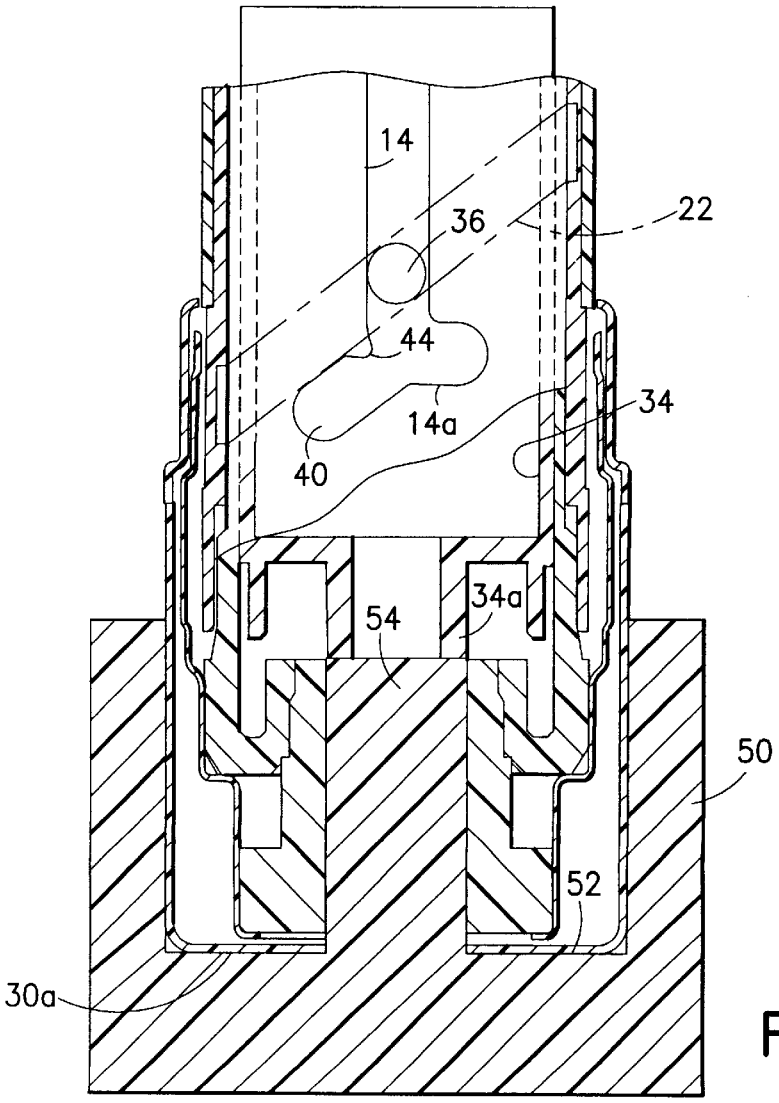
FIG. 3 is a fragmentary sectional view of a lower portion of FIG. 1 showing in section the unlocking fixture engaging the pomade cup having raised it to "unlocked" condition.

The lipstick will operate normally thereafter. The next time that the user propels the pomade cup downward, the spiral track 22 and the detent will urge the lug 36 into the lateral lug retaining slot 14*a*, 14*a'* to hold the cup down against accidental upward movement. When the shell is turned clockwise to raise the pomade cup, the lug will be moved leftward (FIG. 3) up into the slot 14 or 14'. The detent is to the left of the path of the lug as the lug emerges from the lug-retaining slot 14*a*.

By virtue of the structure disclosed, the initial control of the raising of the pomade cup is in the hands of the salesperson. The curious shopper is effectively blocked from raising the pomade cup until the salesperson either places the lipstick in a fixture 50 or inserts some other kind of probe or tool into the opening 30*a* to raise the cup above the detent 44 or 44'. Once the lipstick has been unlocked, it cannot be locked again, and it will operate in the normal fashion.

Variations in the invention are possible. Thus, while the invention has been shown in only one embodiment, it is not so limited but is of a scope defined by the following claim language which may be broadened by an extension of the right to exclude others from making, using or selling the invention as is appropriate under the doctrine of equivalents.

What is claimed is:

1. A locking lipstick container comprising:

a. a tubular inner body having a longitudinal slot therein, the slot having a lower end and a perpendicular hold-down slot at the lower end of the longitudinal slot, the body having an axial opening therein, b. a cam sleeve rotatably surrounding the inner body and having a spiral track therein of a given pitch angle, c. a pomade cup reciprocally disposed in the inner body and having a lug integral therewith and extending out through the slot and into the track, and d. locking means for the lipstick container comprising a downward extension of the lower end of the longitudinal slot in the inner body below the hold-down slot, the extension having an inward detent opposite the hold-down slot, the extension being narrower at the detent than the lug, whereby, when the lug is in the extension and the cam sleeve is turned to raise the cup, the pitch angle of the track drives the lug against the margin of the extension thereadjacent, blocking the rise of the lug and a tool inserted in the axial opening can push the cup vertically upward moving the lug from the extension forcibly past the detent, and, on subsequent retraction of the cup by the cam sleeve, the lug will enter the hold-down slot.

2. A locking lipstick container as claimed in claim 1 wherein the extension is inclined in a direction roughly parallel to the direction of a proximate portion of the spiral track.

3. A locking lipstick container as claimed in claim 1 wherein the extension is in the direction longitudinal of the body, and the lug cannot rise above the detent when the lower end of the inner body is turned in a direction to raise the cup.

4. A process for unlocking a locking lipstick container, the container comprising:

a. a tubular inner body having a longitudinal slot therein formed with an extension at the lower end of the slot, a margin of the extension having an inward detent, the inner body having a lower end having an axial opening therein, b. a cam sleeve rotatably surrounding the inner body and having a spiral track therein, c. a pomade cup reciprocally disposed in the inner body and having a lug integral therewith and extending out through the slot and into the extension, the extension at the detent being narrower than the lug and the margin of the extension generally facing in opposition to the direction in which the lug is pressed by the spiral track as the inner body is turned to raise the cup, the process comprising the step of inserting a probe temporarily through the axial opening in the lower end of the inner body and forcibly engaging the cup and lifting it so that the lug snaps past the detent above the extension to unlock the container.

5. In combination:

A. a locking lipstick container comprising:

a. a tubular inner body having a longitudinal slot therein and a lower end having an axial opening therein, b. a cam sleeve rotatably surrounding the inner body and having a spiral track therein, c. a pomade cup reciprocally disposed in the inner body and having a lug integral therewith and extending out through the slot and into the track, d. locking means for the lipstick container comprising a downward extension of the lower end of the slot in the inner body, the extension receiving the lug, the extension having a margin formed with an inward detent whereat it is narrower than the lug, the detent generally facing in opposition to the direction in which the lug is pressed by the spiral track as the inner body is turned to raise the cup, and B. an unlocking tool independent of the container comprising:

a. a cup-shaped element receiving the lower end of the inner body, the cup-shaped element having a floor with a central upward probe extending into the axial opening and adapted when the inner body approaches the floor to temporarily engage and raise the cup so that the lug is above the detent and moves into the slot.

6. A locking lipstick as claimed in claim 5 wherein the spiral track has a pitch angle and the margin is disposed at an acute angle and is substantially the same as the pitch angle of the spiral track.

* * * * *